US008375498B2

(12) United States Patent
Fuller et al.

(10) Patent No.: US 8,375,498 B2
(45) **Date of Patent: *Feb. 19, 2013**

(54) SWIMMING POOL AND DECK BRUSH

(75) Inventors: Everett O. Fuller, Westminster, CA (US); Martyn L. Fuller, Murrieta, CA (US)

(73) Assignee: Monoarc Inc., Westminster, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/245,543

(22) Filed: Sep. 26, 2011

(65) Prior Publication Data

US 2012/0011672 A1 Jan. 19, 2012

Related U.S. Application Data

(63) Continuation of application No. 12/500,080, filed on Jul. 9, 2009, now Pat. No. 8,024,833, which is a continuation of application No. 12/122,391, filed on May 16, 2008, now abandoned.

(51) Int. Cl.
*E04H 4/16* (2006.01)
*A46B 9/02* (2006.01)

(52) U.S. Cl. ..... 15/1.7; 15/160; 15/200

(58) Field of Classification Search ..... 15/1.7, 15/159.1, 160, 188, 200
See application file for complete search history.

(56) References Cited

U.S. PATENT DOCUMENTS

| | | | |
|---|---|---|---|
| 3,008,160 | A | 11/1961 | West |
| 4,606,091 | A | 8/1986 | Sartori |
| 4,703,535 | A | 11/1987 | Nehls |
| 4,783,868 | A | 11/1988 | O'Callaghan |
| 4,882,802 | A | 11/1989 | LeVere, Jr. |
| D382,117 | S | 8/1997 | Uranga et al. |
| 5,966,771 | A | 10/1999 | Stroud |
| 5,983,431 | A | 11/1999 | Meshulam |
| 6,108,854 | A | 8/2000 | Dingert |
| 6,301,737 | B1 | 10/2001 | Morse |
| 6,319,332 | B1 | 11/2001 | Gavney, Jr. et al. |
| 6,463,619 | B2 | 10/2002 | Gavney, Jr. |
| 6,658,688 | B2 | 12/2003 | Gavney, Jr. |
| 6,671,921 | B1 | 1/2004 | Hickman |
| D511,411 | S | 11/2005 | Weaver |
| D563,107 | S | 3/2008 | Folden |
| 2004/0255427 | A1 | 12/2004 | Gavney, Jr. |

*Primary Examiner* — Randall Chin
(74) *Attorney, Agent, or Firm* — Fulwider Patton LLP

(57) ABSTRACT

A transversely elongated mounting bar curved rearwardly from a centerline and mounting longitudinally projecting bristles on the front side thereof to terminate in free ends deposed in a working plane.

13 Claims, 3 Drawing Sheets

FIG. 7
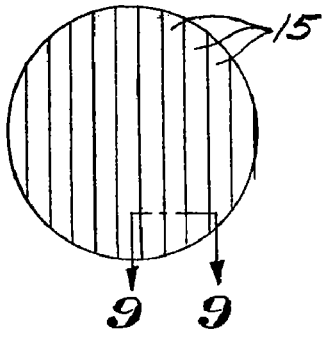
FIG. 8
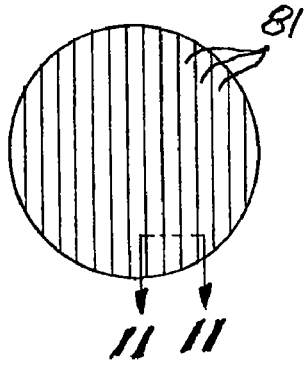
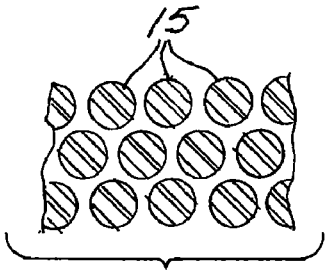
FIG. 9
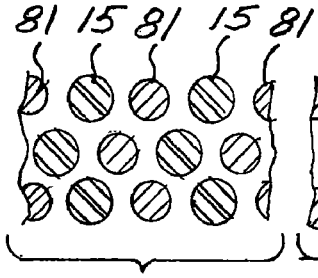
FIG. 10
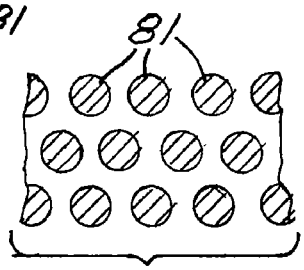
FIG. 11
FIG. 12
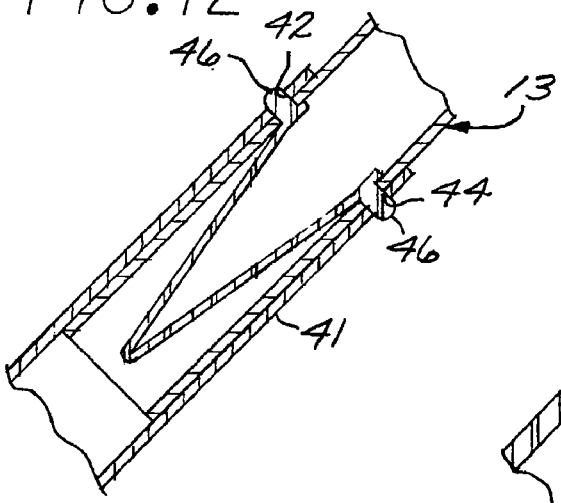
FIG. 13
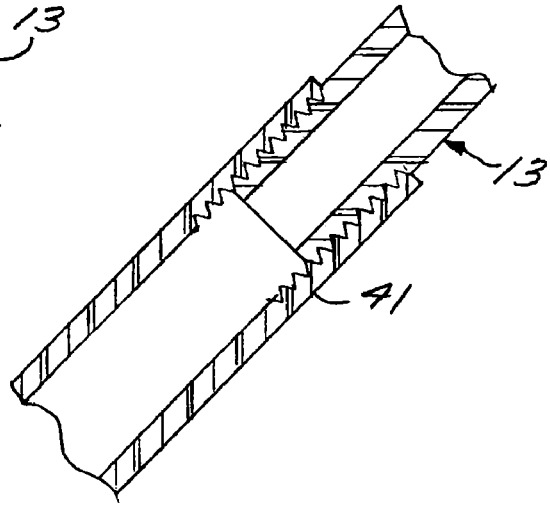

SWIMMING POOL AND DECK BRUSH

CROSS-REFERENCES TO RELATED APPLICATIONS

This is a continuation application claiming priority from U.S. application Ser. No. 12/500,080, filed Jul. 9, 2009 and now U.S. Pat. No. 8,024,833, which was a continuation of application Ser. No. 12/122,391 filed May 16, 2008 now abandoned, both incorporated by reference in their entirely.

BACKGROUND

The present invention relates to brushes that may be used in cleaning swimming pools, swimming pool decks and the like.

DESCRIPTION OF THE PRIOR ART

Residential swimming pools are popular for family and recreational relaxation, particularly in the warmer Mediterranean climates and can lend themselves to heavy usage during warm and hot weather. To protect against contamination and spread of bacteria and the like, the walls of the pools must be cleaned regularly, usually with cleaning solutions applied by mechanical devices such as sprays or brushes. Pool brushes typically incorporate and array of bristles with distal ends intended to follow the contour of the pool walls to provide for application of the solutions and dislodging of deposits and growth clinging to the wall surfaces. Modern day pools often take numerous different shapes, including generally rectangular horizontal cross section shapes, kidney shapes and compound contours dictated by the whim of the architect or pool designer. Many such pools are lined with plaster and incorporate within their walls, sharp or curved corners, ridges, crevices, risers and, depressions and the like which must be cleaned regularly to maintain a sanitary and attractive pool appearance.

Hereto for, the do-it-yourself homeowner and professional pool cleaner alike have been faced with the problem that cleaning brushes are typically configured to either follow a wide swath across the flat side or bottom wall of the pool or to address the ridges, crevices and irregularities thus leaving the workman with the dilemma of either inventorying a number of specialized brushes for the different applications or leaving some of the pools surfaces uncleaned.

In this regard, typically, a brush of some significant lateral span is desired for the planer walls of the pool for efficient and rapid cleaning thereof in a broad swath as the brush is drawn there over. Brushes of this configuration do not function well to follow the contours and irregularities in ridges and crevices formed in the walls thus often making it necessary for the workman to utilize different configurations of brushes, one of a wider span for cleaning the planer and large area walls and the like and especially configured smaller brushes to access the irregular surfaces in crevices, ridges and ribs which would otherwise often be left untouched or inadequately cleaned. Thus, those working in the pool cleaning business have been left with the choice of either utilizing multiple brushes of different configurations for achieving the entire pool cleaning process or consuming inordinate time cleaning the large area surfaces with smaller specially contoured brushes and/or utilizing a large area brush and leaving the contoured areas inadequately cleaned.

Cleaning tools of different configurations have been proposed for various different cleaning applications. Brush handles with multiple brush heads have been proposed. It has also been proposed to construct squeegee and bristle combination devices with various different configurations, including linear, semicircular shape, v-shape and channel shaped backing plates. These constructions have been proposed with squeegees of uniform thickness and generally fail to provide for adequate cleaning swimming pools. Devices of this type are disclosed in U.S. Patent Application No. 2004/0255427 filed Jul. 20, 2004 by Gavney.

Thus, a long standing need has existed for a brush constructed for convenient access into tight corners and skirting's. Such needs have led to the development of brushes with bristles flared laterally outwardly at the opposite sides. It has been proposed that such a brush incorporate a backing bar configured with laterally outwardly angled, parallel tiered, step type lands formed with bores for receipt of tufts of bristles which might flare outwardly for access to corners and skirts and the like. A device of this type is shown in U.S. Pat. No. 4,606,091 to Sartori. Such devices suffer the shortcoming that they are relatively expensive to manufacture, require intricate design to maintain any degree of uniform density of the bristle tips and fail to configure the bristles on the extended radius of curvature of the backing bar thereby placing the bristles, when under load, under a bending movement.

In an unrelated area of the art, it has been proposed to provide a dust broom molded with a backing bar flared linearly upwardly at its opposite ends of large cross-section TPE bristles to dust the corners between the floor and room wall. Such a device is shown in U.S. Pat. No. 6,108,854 to Dingert. Such devices, while affording access to dust and cob webs along corners of a room floor, are configured with the rubber bristles of such large diameter and so widely spaced that the distal ends have no practical application for pool or deck cleaning itself.

SUMMARY OF THE INVENTION

The pool and deck cleaning brush of the present invention includes a curved transverse mounting bar having a distally facing mounting surface which mounts longitudinally projecting discrete bristles having respective lengths sufficient to dispose their respective working ends in a common plane.

BRIEF DESCRIPTION OF THE DRAWINGS

FIGS. 7 and 8 are front sectional views, in enlarged scale, taken from the respective circles designated 7 and 8 in FIG. 4;

FIGS. 9, 10 and 11 are transverse sectional views, in enlarged scale, of bristles included in a first, second and third embodiments of the pool and deck patio brush;

FIG. 12 is a longitudinal sectional view, in enlarged scale taken along the line 12-12 of FIG. 3; and FIG. 13 is a longitudinal sectional view similar to FIG. 12 but of a further embodiment depicting a threaded handle coupling combination.

DETAILED DESCRIPTION OF THE PREFERRED EMBODIMENTS

The brush of the present invention includes, generally, a transversely projecting arcuate mounting bar 11 carried by a handle 13 and mounting an array of generally radially projecting, discrete bristles 15 which terminate at their distal extremities in working ends, evenly spaced to cooperate to form a flat plane 17 that serves as the working surface for the brush bristles. In this construction, the laterally outwardly disposed discrete bristles are relatively long and will serve to, when compressed against a pool surface shown in FIGS. 5 and 6, flare laterally outwardly for cleaning of the curved surfaces and any sharp corners, ridges or crevices without direct contact of the ends of the mounting bar 11 with the orthogonal wall of the pool.

Below and above ground pools have gained immense popularity in adding to family enjoyment and serve as important entertainment focal points. Because of the moisture, humidity and often times heat, the pools must be cleaned regularly to maintain sanitary conditions and pleasing aesthetics. It is a characteristic of many pools that the walls are generally planer or gently rounded but then come together at corners which may be rounded or squared off thus forming contours which may be relatively inaccessible by present day pool cleaning brushes without risking damage to the adjacent pool wall. General efficiency dictates that the pool brush itself should have a wide span to thus provide for cleaning of a broad swath of pool wall area during each swipe of the brush but yet the brush should blend itself to effective cleaning of corners and crevices without the necessity of switching brush heads or the like. It is this function to which the present invention is directed. Compounding the problem is that pools are often lined with a relatively soft plaster or vinyl liner which, when contacted by a hard brush back during vigorous cleaning activity is subject to ready damage or tearing thus leading to costly repairs by skilled craftsman.

Figure 1:
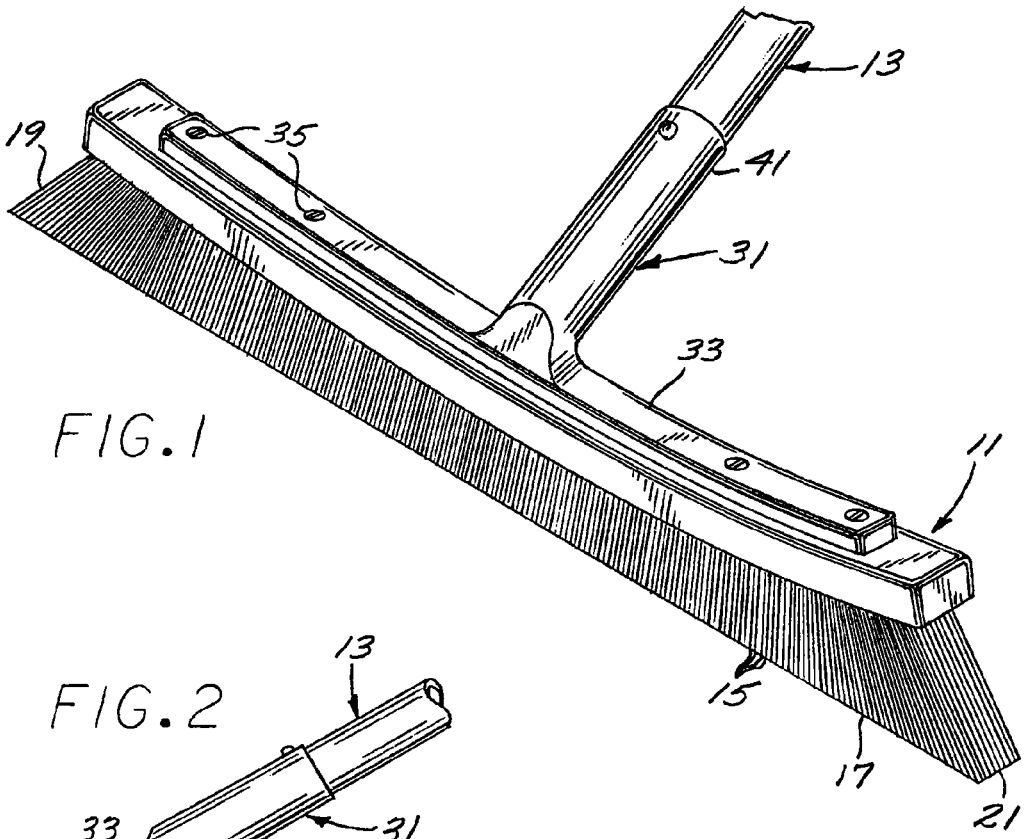
FIG. 1 is a partial perspective view of a pool and deck brush embodying my invention.
Figure 4:
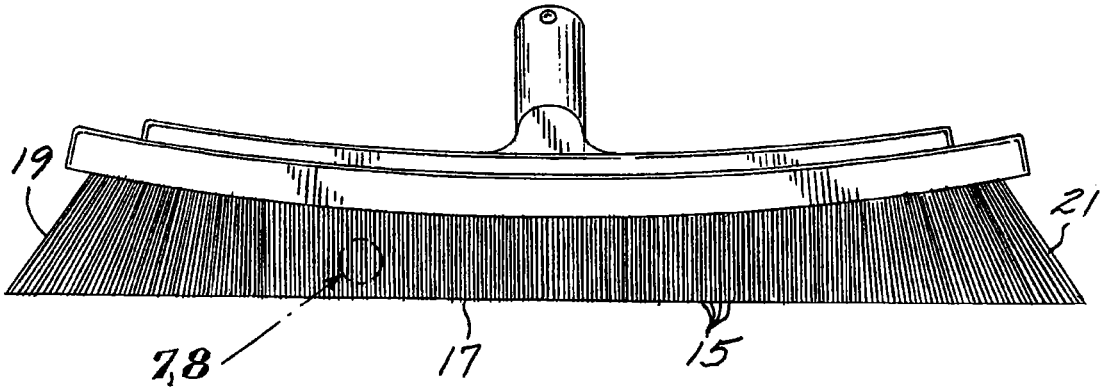
FIG. 4 is a front view of the brush shown in FIG. 1.
Figure 5:
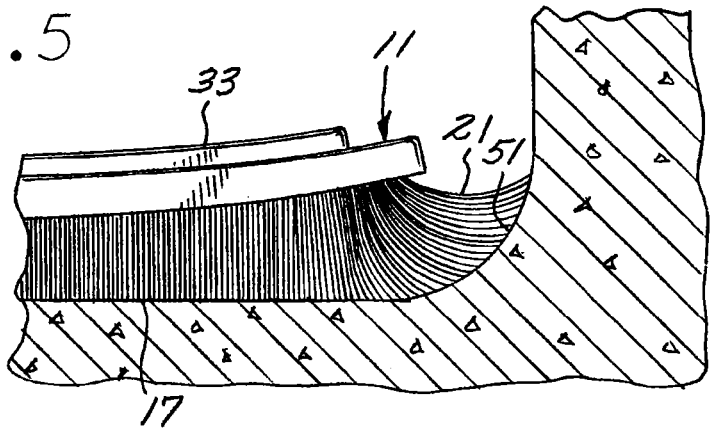
FIG. 5 is a partial front view of the brush shown in FIG. 1 depicted cleaning the corner of a below ground pool.
Figure 6:
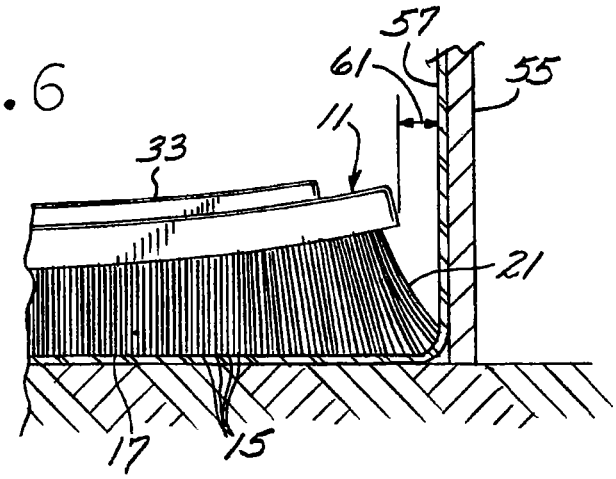
FIG. 6 is a partial front view similar to FIG. 4 but depicting the brush cleaning the corner of an above ground pool.

Referring to FIGS. 1 and 4, the brush of the present invention incorporates a transverse mounting bar 11 which is preferably fabricated from urethane or other soft material to provide a somewhat cushioning effect should contact be made with the side walls of the pool. The bar 11 may be formed of any desired length to provide the swath of cleaning desired and in my preferred embodiments comes in lengths of 9, 20 and 26 inches. The bar 11 is arcuate shape in the lateral direction to form a curvature which may define a sector of a large diameter circle to thus provide a radius of curvature of, for instance, 42 inches. The circular shape of such bar cause the bristles to project in a direction generally radial to the circular shape of such bar. The radius of curvature may vary between 20 and 70 inches to provide the necessary lateral expanse for a wide cleaning swath while assuming a sufficient magnitude of radially outwardly flare. With such a favorable curvature, for a bar with a 26 inch span, the bristles at the opposite lateral ends of the bar have a length of 4 inches for a length medially of about 1¾ inches. The bristles flare outwardly at the opposite edges to provide the lateral extent of the outside bristles at 19 and 21 spaced laterally outwardly 1.5 inches from the horizontal planes of the respective ends of the mounting bar 11. The curvature may vary for pools of different sizes and shape, it only being important that the gentle curvature be such as to provide for generally even, close spacing of the working ends of the bristles, without irregular gaps, to provide effective cleaning shorter medial bristles, while having sufficient length at the opposite ends of the mounting bar to flare outwardly for effective cleaning of the pool corners (FIGS. 5 and 6).

The bristles at the outer extent preferably flare outwardly and downwardly at an angle of 45° relative to the tangent to the curvature of the bar 11 at the respective ends of the bar. This then serves to provide a cushioning and bumper effect by the lateral outwardly disposed bristles which tend to resist lateral, bodily, shifting of the respective ends of the bar 11 against the perpendicular wall of the pool during the cleaning task and provides tactile feedback to the workman to alert him or her that the brush is in close proximity to the perpendicular wall thereby signaling the necessity for careful manipulation to avoid damage. The bristles may be constructed of nylon or any other desirable durable but flexible bristle material and may be mounted to the convex side of the bar 11 during the molding or forming process.

Figure 2:
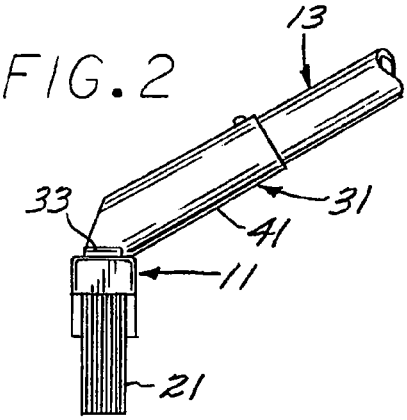
FIG. 2 is right side vies of the brush shown in FIG. 1.
Figure 3:
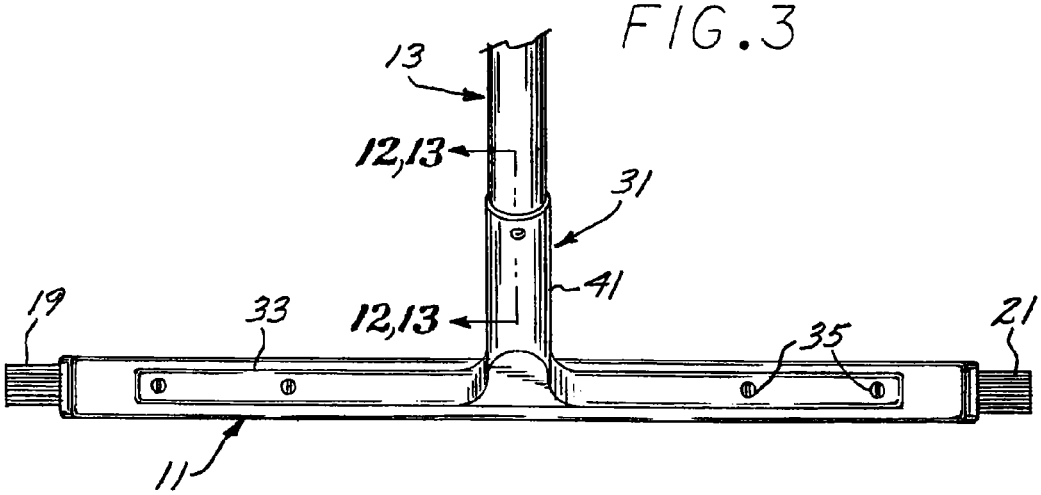
FIG. 3 is a top plan view of the brush shown in FIG. 1.

Referring to FIGS. 2, 3 and 12, in one preferred embodiment, I provide a generally T-shaped handle bracket, generally designated 31, configured with a tube 41 projecting from a cross bar defining a backing strip 33 which curves laterally to compliment the curve of the mounting bar 11. The backing strip is attached to the mounting bar by means of a plurality of screws 35 received in bores spaced along the length of such backing 33 to be screwed into the mounting bar 11. The handle bracket 31 is formed with a relatively large diameter, longitudinal tubular stem 41 for receipt of an elongated pole handle.

Referring to FIG. 12, in one preferred embodiment, the tube 41 is formed with diametrically opposite bores 42 and 44 (FIG. 12) configured to receive depressible buttons 46 carried from respective springs 48 incorporated in a handle stem 13. In the embodiment shown in FIG. 13, the tube 41 is threaded on its interior and the stem 13 configured with external threads for screwing into the tube.

In operation, it will be appreciated that the pool brush of the present invention may be fabricated in many different forms and may be constructed with mounting bars 11 and bristles 15 of relatively soft material for newer pools which typically have smoother finish plaster or vinyl surfaces which are easier to clean. The brush may be constructed with medium flex bristles for general purpose cleaning of pools and the like and with stiffer bristles for older pools which may have more roughened finished surfaces or pools having particularly challenging contours and hard to access crevices, curves and joints. For having dirty work, such as industrial tanks and pool decks, the bristles may be even stiffer or made up of a combination of relatively stiff and relatively flexible bristles as discussed below.

For this embodiment, the bristles as shown in FIGS. 7 and 9 are preferably constructed of Nylon having a small diameter, on the order of 0.40 mm to 0.75 mm but may be constructed of any desired thermoplastics such as polypropylene, polyvinyl chloride or other extruded plastic.

With the relatively stiff but flexible, high density, relatively long bristles, particularly with the bristles 19 and 21 at the lateral ends of the brush, the bristles are free to flare outwardly under influence of the workman's natural scrubbing force applied in the longitudinal direction thereof thus generating a somewhat cushioning effect tending to protect against direct contact by the respective opposite ends of the bar 11 with the perpendicular walls of the pool surface. This serves to inherently protect against damage while enhancing the cleaning function of the flared bristles contacting the juncture between orthogonal pool walls, such as in the curved area 51 typical for underground pools as shown in FIG. 5.

As will be appreciated by those skilled in the art, many above ground pools 55 (FIG. 6) incorporate vinyl liners 57 which line the interior of the side walls and the bottom surface thereof to form a water tight membrane. These vinyl liners 57 are particularly susceptible to scratching and tearing upon contact with the hard surface of a brush structure. The brush of my present invention is uniquely effective in preventing contact with the side wall liner when the brush is utilized to clean the bottom wall and visa versa. With continued reference to FIG. 6, it will be noted that when the brush is pressed against the bottom wall, the laterally outer most bristles 21, being relatively long and flared laterally outwardly, will, upon being pressed downwardly tend to flare laterally outwardly even more thus abutting longitudinally against the vinyl liner on the side wall to provide column stress on the distal extremities of the flared bristles to resist lateral movement of the brush toward that side wall as the bristles access the curved juncture between the side and bottom wall to thus effect the cleaning process while inherently tending to maintain the end of the mounting bar 11 spaced away from the side wall by a distance indicated by the spacer arrow 61.

For some applications, particularly where algae has grown over time and adhered to the surface of the pool, pool trim or even where dirt and residue has collected on the deck, it is desirable to have the benefit of the evenly dispersed bristles of the present invention with the outwardly flare at the opposite ends of the mounting bar but yet have a higher column strength and harder scrubbing tip for the bristles. For this arrangement, we have discovered a stainless steel bristle 81. FIGS. 8 and 11 is highly effective for enhancing the performance of the pool and deck brush of the present invention. The bristles are preferably constructed on 304 type stainless steel having a diameter of between 0.15 mm and 0.30 mm.

As above in FIG. 11, the entire array may be constructed of SS bristles, in some instances of different diameters. In one preferred embodiment we have discovered that a combination plastic and steel bristles is particularly effective. As shown in FIG. 10, in the exemplary construction, we show alternate ones of the bristles being stainless steel to provide 50% of steel bristles and 50% of nylon. As will be appreciated, however, by those skilled in the art a ratio of between 30% and 50% stainless steel bristles to 70% and 50% nylon provide a highly effective scrubbing and cleaning effect. In one preferred embodiment, we have selected 40% stainless steel bristles and 60% nylon bristles.

From the foregoing, it will be appreciated that the pool brush of my present invention provides means for cleaning the many different configurations of pool contours while protecting the undulations in the that surface from damage due to contact with hard brush surfaces.

We claim:

1. A pool and deck cleaning brush to clean the horizontal bottom wall surface of a pool having a side wall rising upward therefrom and comprising;

a transverse, elongated mounting bar to extend along the bottom wall, curved from one end to the other along a predetermined radius of curvature to form a convex distal side having a medial section and opposite extremities terminating in respective opposite ends;

elongated discrete bristles arrayed along the bar having first and second ends, the first ends mounted from the distal side, the bristles being of respective lengths sufficient to terminate in respective second ends located in a working plane spaced from the distal side, the bristles in the medial section projecting in the radial direction relative to the mounting bar and the bristles adjacent the opposite ends flaring distally and laterally outwardly a selected distance beyond the respective vertical planes including the respective opposite ends, the bristles constructed of a material selected from a group consisting of plastic and steel; and a handle affixed to the mounting bar.

2. The pool and deck brush of claim 1 wherein:

the bar is at least 20 inches long; and the bristles are at least 1-¾ inches long.

3. The pool and deck brush of claim 1 wherein:

the steel bristles are cylindrical having diameters of between 0.15 mm and 0.30 mm.

4. The pool and deck brush of claim 1 wherein:

the plastic bristles are cylindrical and have diameters of between 0.40 mm and 0.75 mm.

5. The pool and deck brush of claim 1 wherein:

the bristles are constructed of steel.

6. A pool brush comprising:

a transversely projecting mounting bar curving rearwardly at the outer extremities to form a sector of a circle having a radius of substantially 42 inches;

a handle fitting including a backing strip constructed of stainless steel and formed to compliment the sector of the circle, the backing strip being abutted against the back side of the mounting bar, the fitting further including a tubular socket disposed along a diametrical axis of the circle for receipt of a handle rod;

threaded fasteners fastening the mounting bar to the backing strip;

a high density array of flexible plastic bristles having cross sections no greater than 0.75 mm, mounted on their respective one extremities to the front side of the mounting bar and projecting substantially radially of the sector of the circle to be substantially equally spaced at their respective distal ends, the plurality of bristles including at the laterally opposite extremities of the mounting bar end bristles which angle distally and laterally outwardly at respective angles of substantially 45° to the axis, the plurality of bristles terminating in the respective distal ends disposed in a working plane.

7. The pool brush of claim 6 that includes:

bristles constructed of metal.

8. The pool brush of claim 6 wherein: the bristles are constructed of nylon.

9. A pool and deck cleaning brush to clean the horizontal bottom wall surface of a pool having a side wall rising upward therefrom and comprising:

a transversely elongated mounting bar for disposition horizontally over the bottom wall surface, the bar curved to a radius of curvature of between 20 and 70 inches and a length of substantially 26 inches and configured to form a medial section and opposite extremities terminating in respective opposite ends;

a plurality of close spaced discrete plastic bristles arrayed in close spaced relationship along the distal side of the mounting bar and mounted on respective one extremities to the bar, the bristles projecting from the medial section along respective extended radii of the radius of curvature and the bristles at the opposite extremities flaring laterally outwardly at respective angles of substantially 45° to the tangent of the radius of curvature and projecting distally and laterally outwardly beyond the respective horizontal planes of the respective ends to contact the side wall, the distal ends of the respective bristles terminating in a working plane; and a handle affixed to the mounting bar.

10. A pool brush comprising:

a transversely projecting mounting bar constructed of urethane and curving rearwardly at the outer extremities to from a sector of a circle having a radius of substantially 42 inches;

a handle fitting including a backing strip constructed of stainless steel and formed to compliment the sector of the circle, the backing strip being abutted against the back side of the mounting bar, the fitting further including a tubular socket disposed along a diametrical axis of the circle for receipt of a handle rod; and a high density array of flexible bristles having cross sections no greater than 0.75 mm, connected on their respective one extremities to the front side of the mounting bar and projecting substantially radially of the sector of the circle, the plurality of bristles including at the laterally opposite extremities of the mounting bar end bristles which angle distally and laterally outwardly at respective angles of substantially 45° to the axis, the plurality of bristles projecting distally to terminate in respective distal ends disposed in a working plane, the bristles including metal bristles interspersed with plastic bristles.

11. The pool brush of claim 10 wherein:

the plastic bristles are constructed of nylon.

12. The pool brush of claim 10 wherein:

the bristles are constructed of steel.

13. The pool brush of claim 10 wherein:

at least some of the bristles are constructed of steel.

* * * * *